US007927191B2

(12) United States Patent
Esenwein

(10) Patent No.: US 7,927,191 B2
(45) Date of Patent: Apr. 19, 2011

(54) HAND-HELD POWER TOOL FOR A ROTATING TOOL WITH A GUARD

(75) Inventor: Florian Esenwein, Uhingen-Holzhausen (DE)

(73) Assignee: Robert Bosch GmbH, Stuttgart (DE)

( * ) Notice: Subject to any disclaimer, the term of this patent is extended or adjusted under 35 U.S.C. 154(b) by 208 days.

(21) Appl. No.: 12/278,433

(22) PCT Filed: Sep. 21, 2007

(86) PCT No.: PCT/EP2007/060044

§ 371 (c)(1), (2), (4) Date: Aug. 6, 2008

(87) PCT Pub. No.: WO2008/058796

PCT Pub. Date: May 22, 2008

(65) Prior Publication Data

US 2009/0023372 A1 Jan. 22, 2009

(30) Foreign Application Priority Data

Nov. 13, 2006 (DE) ..... 10 2006 053 301

(51) Int. Cl.
*B24B 55/04* (2006.01)

(52) U.S. Cl. ..... 451/451; 451/452; 451/359

(58) Field of Classification Search ..... 451/344, 451/359, 451, 452
See application file for complete search history.

(56) References Cited

U.S. PATENT DOCUMENTS

| | | | | | |
|---|---|---|---|---|---|
| 4,060,940 | A * | 12/1977 | DeWitt | 451/358 |
| 4,574,532 | A * | 3/1986 | Haberle et al. | 451/451 |
| 4,791,541 | A * | 12/1988 | Simmons | 362/376 |
| 4,924,635 | A * | 5/1990 | Rudolf et al. | 451/344 |
| 5,005,321 | A * | 4/1991 | Barth et al. | 451/359 |
| 5,384,985 | A * | 1/1995 | Jacobsson | 451/344 |
| 5,440,815 | A * | 8/1995 | Inkster | 30/390 |
| 5,766,062 | A * | 6/1998 | Edling | 451/451 |
| 6,464,573 | B1 * | 10/2002 | Keller | 451/451 |
| 6,669,544 | B1 * | 12/2003 | Walz et al. | 451/454 |
| 6,699,114 | B1 * | 3/2004 | Booeshaghi et al. | 451/451 |
| 6,893,334 | B1 * | 5/2005 | Stivers | 451/359 |
| 6,949,017 | B2 * | 9/2005 | Koschel et al. | 451/358 |
| 6,988,939 | B2 * | 1/2006 | Hofmann et al. | 451/344 |
| 7,063,606 | B2 * | 6/2006 | Stierle et al. | 451/359 |
| 7,311,589 | B2 * | 12/2007 | Wiker | 451/451 |
| 2004/0014412 | A1 * | 1/2004 | Hofmann et al. | 451/451 |
| 2006/0052041 | A1 * | 3/2006 | Wiker | 451/451 |

FOREIGN PATENT DOCUMENTS

| | | |
|---|---|---|
| DE | 195 18 854 | 11/1996 |
| DE | 101 24 439 | 11/2002 |
| DE | 101 58 334 | 2/2003 |
| DE | 102 59 520 | 7/2004 |
| WO | 2007/131827 | 11/2007 |

* cited by examiner

*Primary Examiner* — Eileen P. Morgan
(74) *Attorney, Agent, or Firm* — Michael J. Striker

(57) ABSTRACT

The invention relates to a portable power tool (44) for a rotating, preferably disk-shaped tool. Said portable power tool comprises a machine housing (43), having a machine neck (22) to which a protective hood (1) can be detachably secured to at least partially cover the tool. Said protective hood (1) comprises a protective hood neck (2) and a clamp (29) is provided for the detachable securing. In order to provide an anti-rotation lock (48) which is effective between the machine neck (22) and the protective hood (1), a respective profiled structure (15) is arranged/configured on the clamp (29) and on the protective hood neck (7) or on the protective hood neck (7) and on the machine neck (22) or on the protective neck (7) and on the clamp (29) and on the machine neck (22).

19 Claims, 5 Drawing Sheets

HAND-HELD POWER TOOL FOR A ROTATING TOOL WITH A GUARD

CROSS-REFERENCE TO A RELATED APPLICATION

The invention described and claimed hereinbelow is also described in German Patent Application DE 10 2006 053 301.1 filed on Nov. 13, 2006. This German Patent Application, whose subject matter is incorporated here by reference, provides the basis for a claim of priority of invention under 35 U.S.C. 119(a)-(d).

BACKGROUND OF THE INVENTION

Hand-held power tools for rotating, preferably disk-shaped tools are known. They are used in diverse applications, e.g., as angle grinders. Hand-held power tools of these types include guards, which serve to ensure that sparks and material particles—which are slung off of the rotating tool, e.g., grinding or cutting disks, during operation of the hand-held power tool—do not reach the operator and/or the surroundings. The guard also serves to protect the operator and the surroundings if the tool should become destroyed. It is possible for a cutting disk to burst in a work piece if it becomes tilted while rotating. The guard must ensure that fragments of the burst cutting disk, some of which are slung off with high energy, are kept away from the operator. In general, the guards cover the work piece only in segments, however, e.g., in an angular range of approximately 180°, in order to provide the operator with freedom to work with the rotating tool and the work piece. To enable the guard to be rotated in the desired range, it is known per the related art to attach the guard in a detachable manner, e.g., using a clamping band located on the guard. Various designs are known to accomplish this, with which the circumference of a clamping band is expanded and constricted by releasing and tightening a clamping screw, thereby enabling the guard to be retained on the machine neck via a clamping effect. Adjusting the guard is a complicated procedure, however, and requires a tool. Under certain circumstances, the operator may therefore forgo adjusting the guard properly. The positioning of the guard on the collar of the machine would therefore not be optimal, and adequate protection of the operator would no longer be ensured. Publication DE 102 59 520 A1, for example, therefore makes known to provide a clamping cuff on the guard, the circumference of which is adjustable using a lever (clamping lever), thereby enabling the guard to be released from its locked position using a simple lever motion so that it may be rotated around the clamping neck. Recesses are formed in the machine clamping neck in which a pawl mounted on the clamping band and/or the clamping lever of the clamping band engage in order to lock the guard in certain angular positions after the guard has been swiveled relative to the hand-held power tool. A disadvantage of this is that the guard fits only one type of hand-held power tool, with the pawl being formed on the guard.

SUMMARY OF THE INVENTION

The object of the present invention is to provide a refinement that avoids the disadvantages stated above and provides greater protection and comfort for the operator of the hand-held power tool.

To this end, a hand-held power tool for a rotating, preferably disk-shaped tool is provided, that includes a machine housing with a machine neck, to which a guard for at least partially covering the tool is detachably connected. The guard includes a guard neck and is provided for the detachable attachment of a clamp. A profiling is located/formed on the clamp and the guard neck, or on the guard neck and the machine neck, or on the guard neck and the clamp and the machine neck for forming a rotational lock between the machine neck and the guard. Unlike the related art, according to which the guard is essentially retained on the machine neck via a frictional connection and is rotationally locked via a further structural element, e.g., a pawl, the present invention includes a profiling, which may be formed or located on the clamping cuff and, corresponding thereto, on the guard neck, or on the guard neck and the machine neck, or on the guard neck and the clamping cuff and the machine neck. In this context, a "profiling" refers, in particular but not exclusively, to a sequence of essentially identical raised areas and recesses in a cross section, which approximately form a wavy line. It is provided that the profiling is located either on the clamping cuff and the guard neck—in which case the designs of the clamping cuff and the guard neck match, thereby preventing rotation when the profiling is engaged—or on the guard neck and the clamping cuff, or on the machine neck and the guard neck and the clamping cuff, i.e., on all three elements, not just on two of the three. The profilings are designed such that they match on the individual elements, i.e., they result in a form-fit and non-positive engagement. Any type of profiling is feasible that is formed via an extension of the actual plane of the outer and/or inner surface of the particular part, i.e., not only a wavy profile, but also, e.g., a design as a nubby profile with matching recesses on the other part, etc.

In a further refinement it is provided that the clamping cuff is designed as a separate component and is attached to the machine housing. Unlike the related art, the clamping cuff is not designed as part of the guard, e.g., as a component of the guard neck, which, according to the related art, is typically designed as a ring that is open and may be closed, and the diameter of which may be increased or reduced, using a clamping device of the clamping cuff (e.g., using a screw or a lever). Instead, the clamping cuff is designed as a separate component that is not connected with the guard, but that accommodates the guard only after the guard has been installed on the hand-held power tool. The clamping cuff is preferably attached to the machine housing such that the guard may be released from the machine housing of the hand-held power tool without any additional parts, and so that it may also be reattached.

In a preferred embodiment, the machine neck extends concentrically with the guard neck. This allows the guard to be rotated around the machine neck equidistantly therefrom.

In a particularly preferred embodiment, the guard neck is enclosed by the clamping cuff. An annular open space is therefore provided between the clamping cuff, which is attached to the machine housing, and the machine neck, into which the guard neck is inserted and engaged. If the clamping cuff is then applied (i.e., engaged and tightened), a form-fit and non-positive connection is established—which is above and beyond the frictional connection known from the related art—thereby bringing about an absolutely non-rotatable retention of the guard on the hand-held power tool. This design also enables the entire guard to be released from the hand-held power tool very easily and comfortably. This applies, in particular, when the clamping cuff may be opened and closed using a clamping lever known per the related art for increasing and decreasing the circumference of the clamping cuff.

In a preferred embodiment, it is provided that the machine neck and/or the guard neck include(s) a compensating element, in particular a ring made of an elastic material, in particular rubber, to compensate for tolerances between the guard neck and the machine neck. Using this compensating element, it is possible to compensate for any tolerances between the machine neck and/or the guard neck and/or the clamping cuff, and, in particular, to ensure that the parts have adequate large-area contact with each other.

According to a further preferred embodiment of the present invention, it is provided that the guard neck encloses the machine neck entirely or partially. The guard neck may be designed as completely annular or with an annular shape that is open only in a very small region, so that the machine neck is essentially enclosed entirely by the guard neck. It may also enclose the machine neck only partially.

It is only necessary for the guard neck and machine neck to come in contact with each other to the extent that the profiling described above and formed on the individual components engages.

In another preferred embodiment, the guard neck is designed as an annular element or an annular-segment element. When designed as an annular element, the guard neck encloses the machine neck in an annular manner. When designed as an annular-segment element, it encloses the machine neck in an annular manner only in sections. The latter variant is preferred, in particular, when it is not practical, desired, or possible—for structural reasons—to design the entire neck of the protective disk to be annular in shape. For example, the special design of the guard neck may be provided only in the angular range that is also covered by the protective disk.

In a further embodiment, the clamping cuff is a clamping device whose diameter decreases when it is tightened, or it includes such a clamping device. The guard neck is clamped and, therefore, fixed in place by the clamping cuff via a reduction in the diameter of the clamping device, which may be designed, e.g., as a clamping band that is actuated using a lever (e.g., a clamping lever or T-handle known from the related art). This results in a frictional connection and, when the profiling engages, a form-fit and non-positive connection.

In a further preferred embodiment, it is provided that the rotation lock—achieved via the profiling—is designed as an adjustable rotation lock for the guard relative to the machine neck. The rotation lock, which is formed by the profiling described above, is designed such that it permits the guard to rotate relative to the machine neck within a certain rotational range, and to be fixed in position as desired. After opening the clamping cuff, the operator may therefore disengage the guard from the profiling, change the position of the guard in the profiling, and fix the guard in the new position relative to the machine neck. This may be brought about, in particular, by designing the profiling as a complete circle on all profiled elements, or as a circular segment or section such that a circular section is profiled around a greater region than is another circular section that is formed, e.g., on the guard, thereby ensuring that it may be rotated and fixed in a new position. Further details are shown in the figures.

In a further embodiment of the present invention, it is provided that the clamping cuff includes a clamping cuff reinforcing element, which is designed in particular as a semi-ring. The clamping cuff is therefore enclosed by a reinforcing element around the outer circumference, at least in sections, e.g., in the shape of part of a ring, the reinforcing element being, e.g., riveted or welded in place in order to prevent the clamping cuff from changing shape too drastically, since this could result in instabilities and material wear. It is therefore ensured that the form-fit connection between the profiling and counter-profiling is securely established, and that a profiling formed on the clamping cuff does not become deformed by the repeated expanding and constricting of the circumference of the clamping cuff for purposes of clamping.

Further advantageous embodiments result from the subclaims and combinations thereof.

The present invention is explained below in greater detail below with reference to the figures.

DESCRIPTIONS OF THE PREFERRED EMBODIMENTS

Figure 1:
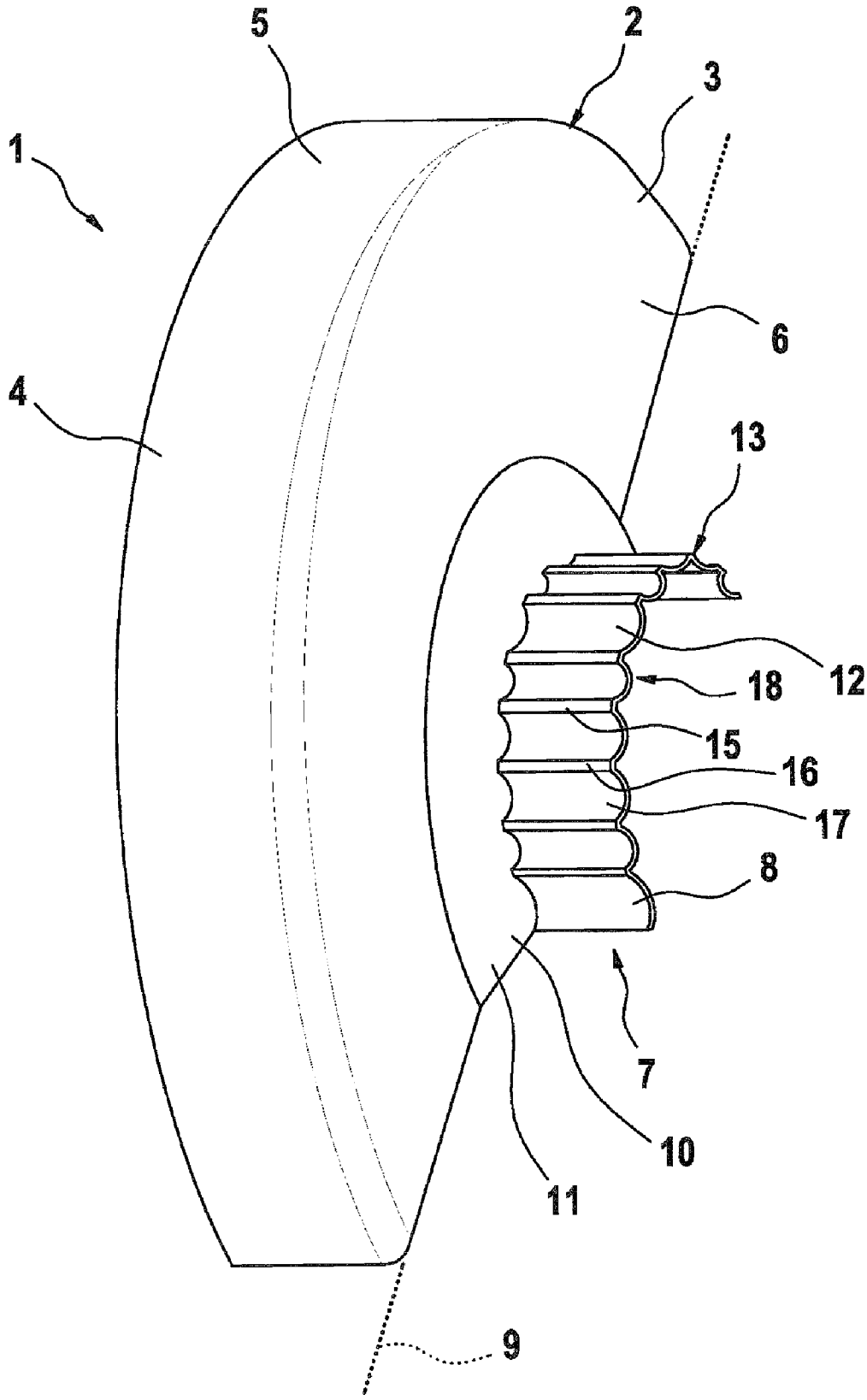
FIG. 1 shows a guard with a guard neck, which is designed as an annular-segment element.

FIG. 1 shows a guard 1 for a not-shown hand-held power tool, i.e., an angle grinder. Guard 1 is designed as a type of pot section 2, with a guard base 3 and a guard edge 4. Guard edge 4 is designed essentially as annular section 5. Guard base 3, which abuts annular section 5 on one side, essentially forms a semicircle 6. A guard neck 7 is formed concentrically with an assumed center point of semicircle 6, guard neck 7 including a guard wall 8, which extends essentially perpendicularly to guard base 3. Guard neck 7 is formed as a semicircle around the assumed center of semicircle 6, which is therefore concentric with the same line of intersection 9. Guard neck 7 is therefore designed as an annular-segment element. A material reinforcement 10 and/or offset 11 are/is provided between guard base 3 and guard neck 7 to increase the stiffness and robustness. Guard neck 7, which is designed as a guard neck semi-ring 12, includes a profiling 15 on its outer circumferential side 13 and on its inner circumferential side 14 in a manner such that profiling 15 is composed of circumferential raised areas 16 and circumferential recesses 17. This results—in the broadest sense—in a wavy profiling 18. Profiling 15 may be designed accordingly on outer circumferential side 13 and inner circumferential side 14, e.g., by manufacturing guard neck semi-ring 12 as a shaped stamped part or a shaped diecast part. Inner circumferential side 14 and outer circumferential side 13 may also have different profilings, however.

Figure 2:
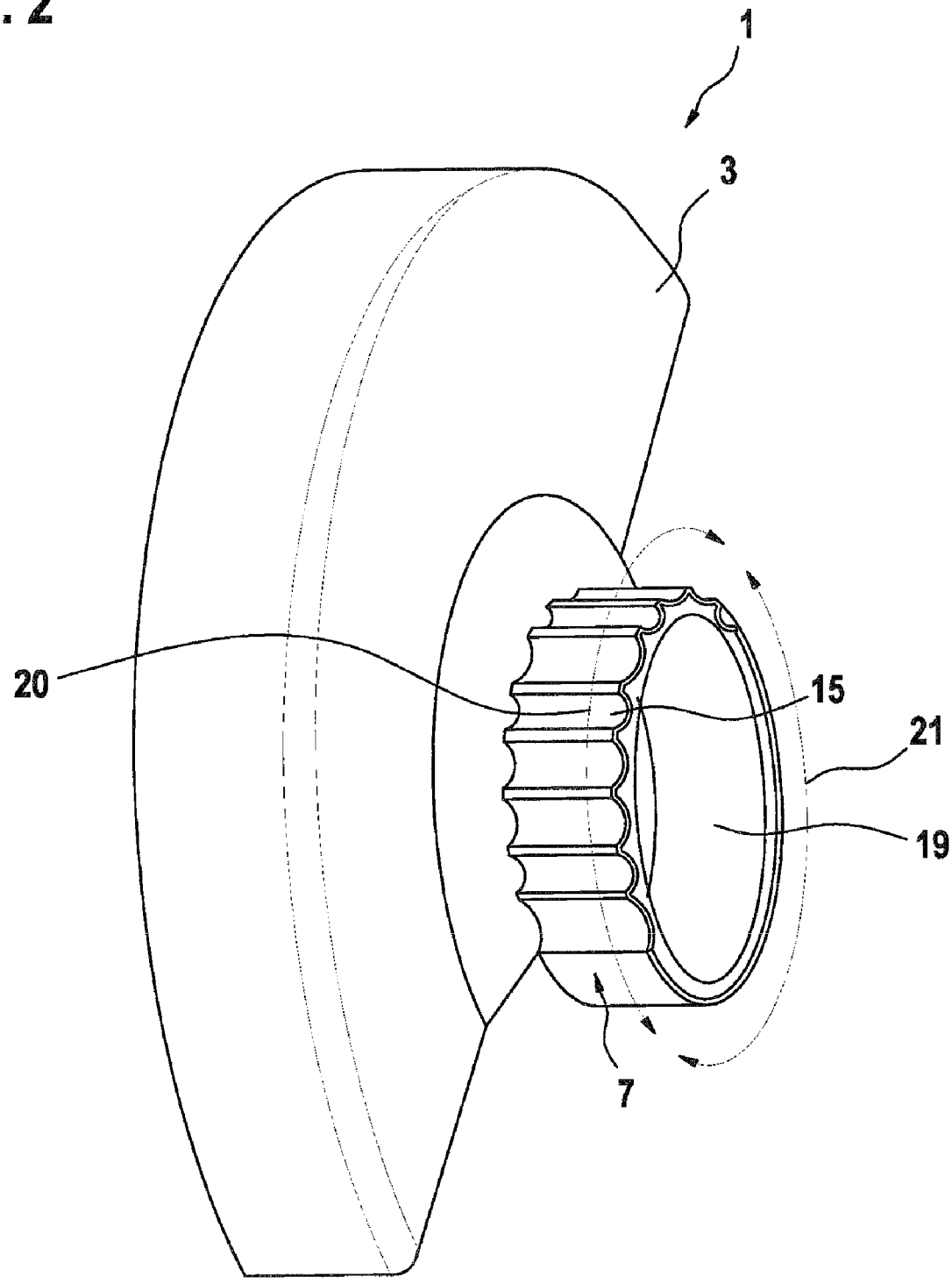
FIG. 2 shows a guard with a guard neck, which is designed as an annular element.

FIG. 2 shows a guard 1 of the generic type described with reference to FIG. 1. The difference is that guard neck 7 is designed as guard neck complete ring 19 and/or as annular element 47. Annular element 47 includes—in the annular range that is also covered by guard base 3—a profiling 15, as described above with reference to FIG. 1. Guard neck complete ring 19 is therefore subdivided into a profiled region 20 and a non-profiled region 21. This makes it possible to limit the angular displacement of guard 1 relative to the hand-held power tool. The operator may therefore not swivel the guard around a complete circle, but only around a circular segment that is defined by the location of profiling 15 and the not-shown counter-profiling on a machine neck of the hand-held power tool.

Figure 3:
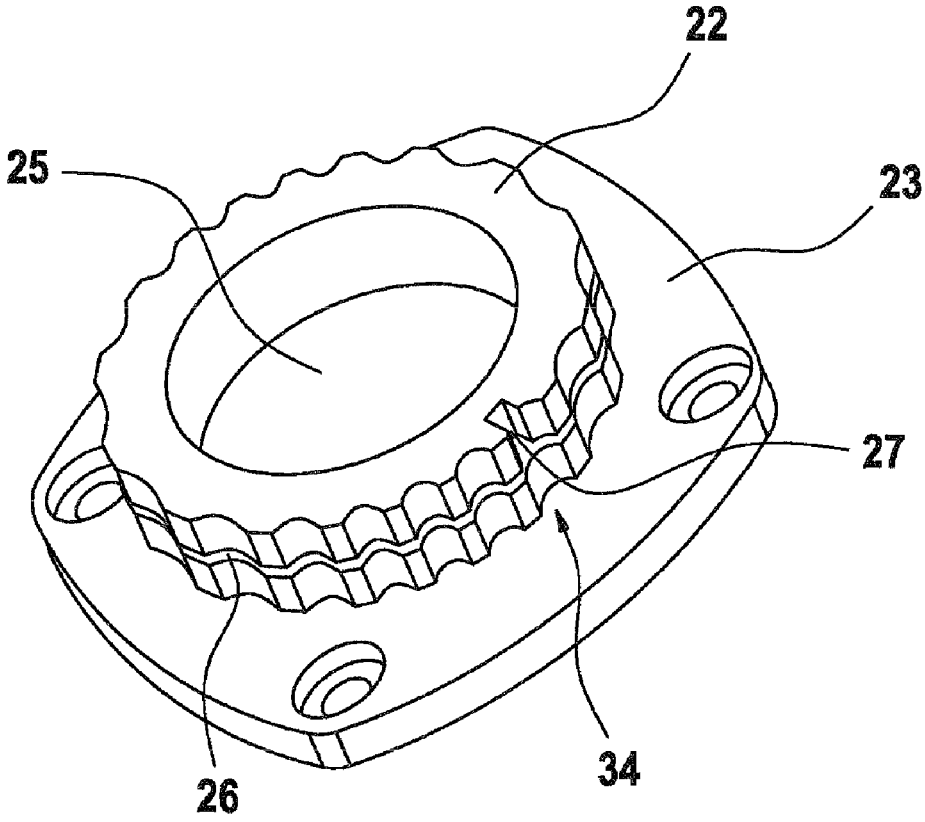
FIG. 3 shows a machine neck with a rotation lock.

FIG. 3 shows a machine neck 22 as a configuration that is flange-mounted to a transmission cover plate 23 and is formed as a single piece therewith. Machine neck 22 includes a counter-profiling 24 on the outer circumferential side that corresponds with the profiling shown in FIG. 1 and therefore has a matching shape in particular. Guard 1, which is not shown here, is slid with not-shown guard neck 7 over machine neck 22. Profiling 15 on guard 1 engages in counter-profiling 24 and establishes a form-fit and non-positive connection, in particular when further means, e.g., a clamping band, are used. Machine neck 22 also includes a concentric recess 25, through which a not-shown drive shaft is guided in order to guide the rotating tool shown. Machine neck 22 also includes a circumferential fastening groove 26, into which a groove-engagement element, e.g., a cam, formed on the inner circumference of guard neck 7, engages via a recess formed in guard neck 7 as groove inlet 27. In this manner, a rotation lock 34 is formed on guard neck 7 in interaction with the groove-engagement element, which prevents guard 1 from accidentally sliding off of machine neck 22.

Figure 4:
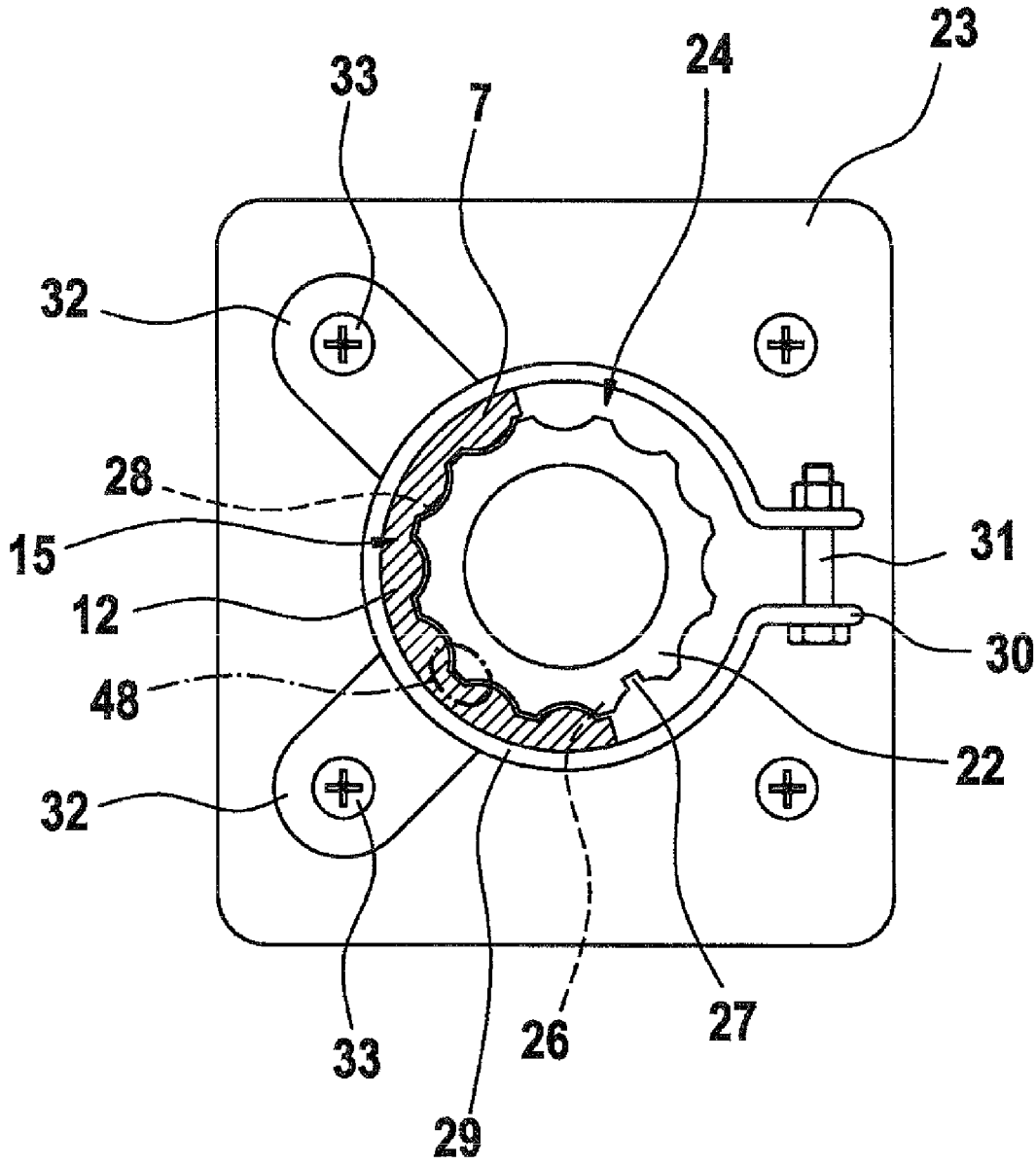
FIG. 4 shows the procedure for attaching a guard per FIG. 1 to the machine neck, in a cross-sectional view.

FIG. 4 shows a cross-sectional top view of the installation of guard neck 7 on a machine neck 22, which is designed as a single piece with transmission cover plate 23. Machine neck 22 includes counter-profiling 24, which engages in profiling 15 of guard neck 7 in a form-fit manner. A rotation lock 48 is formed as a result. Machine neck 22 also includes groove inlet 27, which is designed as a recess in machine neck 22 and is used to insert groove-engagement element 28 into circumferential fastening groove 26, which is not visible here due to the perspective of the illustration. Guard neck 7 is designed as guard semi-ring 12, which permits guard 1 to be displaced around a complete circle on the machine neck relative to machine neck 22 and transmission cover plate 23 on circumferential counter-profiling 24 of machine neck 22. Guard neck 22 is enclosed by a clamping collar 29, which is designed as an open clamping ring 30. The circumference of open clamping ring 30 is increased using clamping means 31, which are depicted only symbolically here and may have any design of clamping means known in the related art, in order to disengage guard neck 7 from profiling 15 and counter-profiling 24 and remove the guard from machine neck 22. The circumference of open clamping ring 30 may also be decreased, in order to press guard neck 7 with profiling 15 into counter-profiling 24 in a form-fit manner and to establish a non-positive/frictional connection between clamping cuff 29 and guard neck 7 and machine neck 22. Clamping cuff 29 includes two fastening tabs 32, which are retained on the not-shown machine housing of transmission cover plate 23 using screw connection 33, which may also be the screw connection between transmission cover plate 23 and the not-shown machine housing. Fastening tabs 32 also serve to ensure correct rotation of clamping cuff 29 relative to transmission cover plate 23. Transmission cover plate 23 is shown merely as an example. It is also possible to design the machine neck directly on a transmission housing or on another part of the housing of the hand-held power tool, provided that the necessary position relative to the rotating tool and/or its drive spindle—which is not shown here—is ensured.

Figure 5:
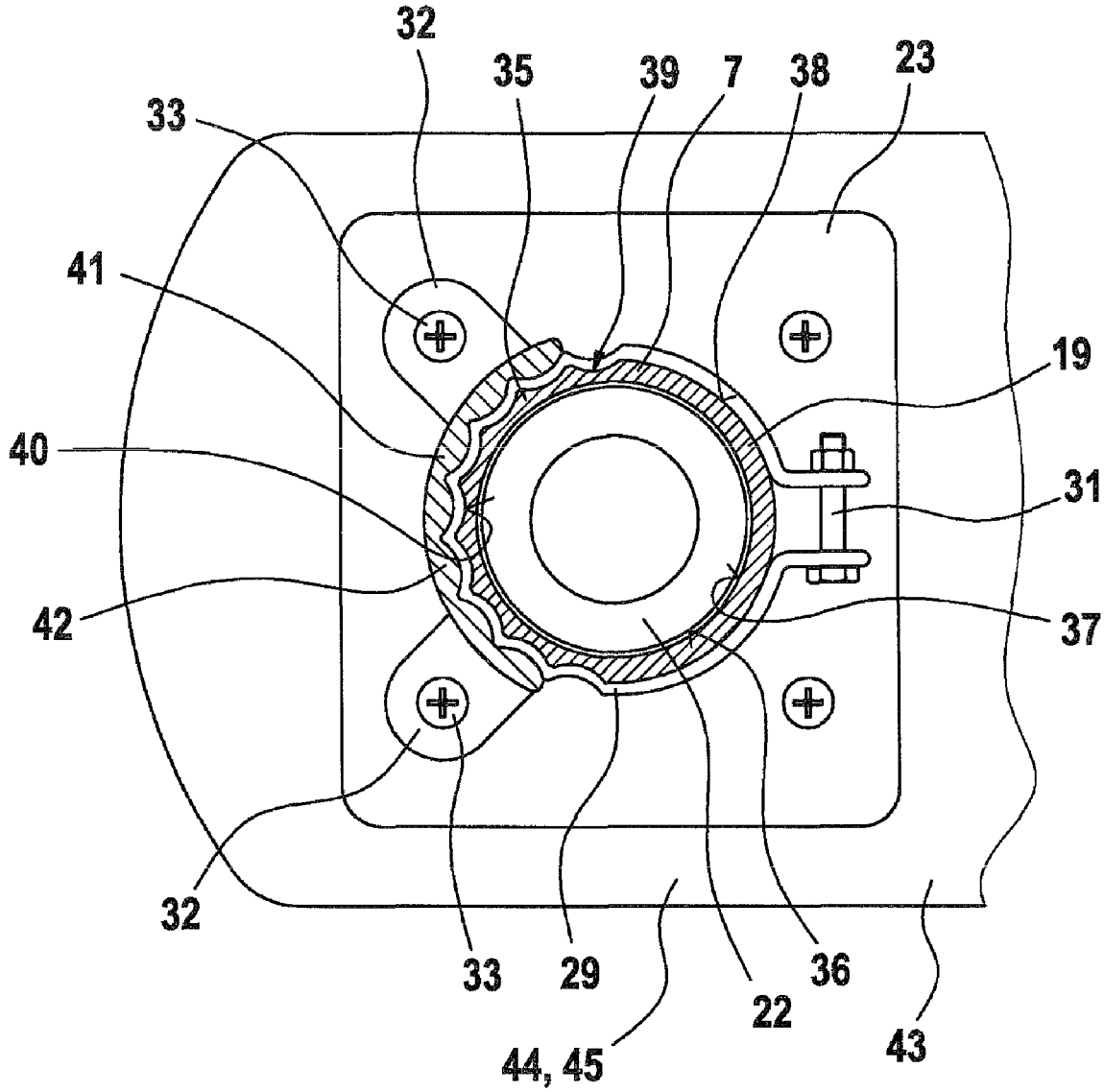
FIG. 5 shows the procedure for attaching a guard per FIG. 2 to the machine neck, in a cross-sectional view.

FIG. 5 shows, in a cross-sectional top view, the installation of guard neck 7—which is designed a guard neck complete ring 19, but which does not include a guard neck semi-profiling 35—on machine neck 22, which includes a smooth (non-profiled) machine neck outer wall 36. As a result, guard neck 7 has a non-profiled guard neck inner side 37, and it includes a guard neck outer profiling 39 on a guard neck outer side 38. Guard neck 7 is enclosed by clamping cuff 29, which includes a clamping cuff profiling 40 that matches guard neck outer profiling 39. Clamping cuff 29 also includes clamping means 31, which are depicted symbolically here. A clamping cuff reinforcing element 41 is installed on clamping cuff 29 opposite to clamping means 31, for dimensional stabilization and reinforcement of clamping cuff 22. Clamping cuff reinforcing element 41 is designed as semi-ring 42 and is fixedly connected with clamping cuff 29, e.g., it is welded together therewith. Clamping cuff 29 is also retained on transmission cover plate 23 via fastening tabs 32, which are held in place via screw connections 337 which serve to fix transmission cover plate 23 in place in a machine housing 43 of a hand-held power tool 44, i.e., an angle grinder 45.

What is claimed is:

1. A hand-held power tool, comprising: a disc-shaped tool; a machine housing having a machine neck for carrying said tool; a guard detachably connected with said machine neck and at least partially covering said tool, said guard having a guard neck; a clamping cuff attached to said machine housing, said cuff having a decreasable diameter and enclosing said guard neck when said guard is connected to said machine neck and wherein the diameter of said cuff is decreased to removably hold said guard on said machine neck; and a profiling provided on a pair of elements selected from the group consisting of: said clamping cuff and said guard neck, and said guard neck and said machine neck, the profiling forming a rotational lock for preventing rotation of said elements relative to one another.

2. A hand-held power tool as defined in claim 1, wherein said machine neck extends concentrically to said guard neck.

3. A hand-held power tool as defined in claim 2, wherein an element selected from the group consisting of said machine neck, said guard neck and both includes a compensating element which compensates for tolerances between said guard neck and said machine neck.

4. A hand-held power tool as defined in claim 3, wherein said compensating element is a ring composed of an electric material.

5. A hand-held power tool as defined in claim 4, wherein said ring is composed of rubber.

6. A hand-held power tool as defined in claim 1, wherein said guard neck encloses said machine neck in a manner selected from the group consisting of enclosing the machine neck entirely over its circumference and enclosing said machine neck partially over a part of its circumference.

7. A hand-held power tool as defined in claim 1, wherein said guard neck is a neck selected from the group consisting of an annular element and an annular segment element.

8. A hand-held power tool as defined in claim 1, wherein said clamping cuff includes a clamping device with a diameter increasing during tightening of said clamping cuff.

9. A hand-held power tool as defined in claim 1, wherein said rotation lock is an adjustable rotation lock for said guard relative to said machine neck.

10. A hand-held power tool as defined in claim 1, wherein said clamping cuff has at least one fastening tab for attachment to said machine housing.

11. A hand-held power tool as defined in claim 10, wherein at least one fastening tub extends in a radial direction.

12. A hand-held power tool as defined in claim 1, wherein said machine neck has a fastening groove which extends around at least a portion of a circumference of said machine neck and interacts with at least one groove-engagement element provided on said guard neck to form a rotation lock for said guard.

13. A hand-held power tool as defined in claim 12, wherein said fastening groove includes a groove inlet.

14. A hand-held power tool as defined in claim 13, wherein said groove-engaging element is an element selected from the group consisting of a cam and an element including a cam.

15. A hand-held power tool as defined in claim 1, wherein said clamping cuff includes a clamp-reinforcing element.

16. A hand-held power tool as defined in claim 15, wherein said clamp-enforcing element is a semi-ring.

17. A hand-held power tool as defined in claim 1, wherein said profiling has a sequence of circumferential raised area and circumferential recesses.

18. A hand-held power tool as defined in claim 1, wherein said profiling is a wavy profiling.

19. A hand-held power tool as defined in claim 1, further comprising attaching means which attach said clamping cuff as the separate component to said machine housing.

* * * * *